US006345880B1

(12) United States Patent
DeBoer et al.

(10) Patent No.: US 6,345,880 B1
(45) Date of Patent: Feb. 12, 2002

(54) NON-WETTING PROTECTIVE LAYER FOR INK JET PRINT HEADS

(75) Inventors: Charles D. DeBoer, Palmyra; Xin Wen, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/326,363

(22) Filed: Jun. 4, 1999

(51) Int. Cl.[7] ..... B41J 2/135
(52) U.S. Cl. ..... 347/45; 347/44; 347/47
(58) Field of Search ..... 347/47, 45, 44, 347/46

(56) References Cited

U.S. PATENT DOCUMENTS

| | | | | |
|---|---|---|---|---|
| 4,306,245 A | | 12/1981 | Kasugayama et al. | |
| 4,555,062 A | * | 11/1985 | You | 347/45 |
| 5,073,785 A | * | 12/1991 | Jansen et al. | 347/45 |
| 5,305,015 A | | 4/1994 | Schantz et al. | |
| 5,350,616 A | | 9/1994 | Pan et al. | |
| 5,365,255 A | * | 11/1994 | Inoue et al. | 347/45 |
| 5,378,504 A | * | 1/1995 | Bayard et al. | 347/45 |
| 5,426,458 A | | 6/1995 | Wenzel et al. | |
| 5,431,722 A | | 7/1995 | Yamashita et al. | |
| 5,725,647 A | | 3/1998 | Carlson et al. | |
| 5,738,716 A | | 4/1998 | Santilli et al. | |
| 5,783,519 A | * | 7/1998 | Morrison et al. | 428/195 |
| 5,910,372 A | * | 6/1999 | Griffin et al. | 428/429 |
| 6,016,601 A | * | 1/2000 | Takemoto et al. | 347/47 |
| 6,074,040 A | * | 6/2000 | Usui et al. | 347/45 |
| 6,156,389 A | * | 12/2000 | Brown et al. | 427/295 |

FOREIGN PATENT DOCUMENTS

| | | |
|---|---|---|
| EP | 0 621 136 A2 | 10/1994 |
| GB | 2 203 994 B | 12/1991 |

* cited by examiner

*Primary Examiner*—John Barlow
*Assistant Examiner*—Manish S Shah
(74) *Attorney, Agent, or Firm*—Walter S. Stevens

(57) ABSTRACT

An ink jet print head is provided that includes a nozzle plate having an outer metal layer having nozzles for ejecting ink drops, and a coating of a non-wetting polymer chemically bound over the outer surface of the metal layer of the plate. Preferably, the polymer is a block polymer having a head that includes the chemical group that chemically bonds with the outer metal layer, and a tail that is hydrophobic. The resulting polymer coating prevents inks from pooling, drying, and creating deposits which would otherwise impede or clog the ink jet nozzles. The chemical bonding between the non-wettable polymer and the metal surface creates a highly durable polymeric layer that resists being wiped off during both printing and head cleaning operations.

9 Claims, 2 Drawing Sheets

NON-WETTING PROTECTIVE LAYER FOR INK JET PRINT HEADS

FIELD OF THE INVENTION

This invention generally relates to protective layers for ink jet print heads, and, more particularly, to the provision of a non-wetting protective layer for preventing the drying and accumulation of ink around the nozzles of such print heads which would otherwise interfere with the printing operation.

BACKGROUND OF THE INVENTION

Ink jet printing is a non-impact technique for producing images by the deposition of ink droplets on a substrate (which may be paper, transparent film, fabric, etc.) in response to digital signals. Ink jet printers have found broad applications across markets ranging from industrial labeling to short-run printing to desktop documents and pictorial imaging.

Conventional continuous ink jet printing utilizes electrostatic charging tunnels that are placed close to the point where the ink drops are formed in a stream. The "tunnels" impart an electrical charge to some of the drops so that the resulting stream consists of a mixture of charged and uncharged drops. The charged drops may be deflected downstream by the presence of deflector plates that have a large potential difference between them. A gutter, sometimes known as a "catcher," may be used to intercept the charged drops while the uncharged, undeflected drops are free to strike the recording medium. If there is no electric field present, or if the drop break-off point is sufficiently far from the electrical field (even if a portion of the stream before the drop break-off point is in the presence of an electrical field) then charging will not occur and all of the ink drops will strike the recording medium. In this manner, modulation of the intensity and distance of the electric field with respect to the stream of ink droplets modulates the density of ink deposition on the medium.

Inks for high-speed ink jet drop printers must have a number of special characteristics. Such inks must be electrically conductive, having a resistivity below about 5,000 ohm-cm, and preferably below about 500 ohm-cm. For good fluidity through small nozzles, such inks must have a viscosity in the range between 1 and 15 centi-poses at 25° C. Typically, water-based inks are used because their inherent conductivity and viscosity is within the ranges required for operability. In addition to conductivity and fluidity, the inks must be stable over long periods of time, compatible with ink jet materials, free of microorganisms, smear resistant after printing, fast-drying on paper, and waterproof after drying.

In recent years, in order to produce higher resolution and higher quality prints, the nozzle openings in the print heads of ink jet printers have become smaller so that the printers can generate smaller ink drop sizes. Unfortunately, these smaller nozzle openings are more sensitive to the accumulation of deposits from dried out water based inks and other contaminations. Such deposits can adversely affect both the size and placement accuracy of the ink jet drop, and even plug the nozzle opening completely. This sensitivity has spawned the development of a number of devices and techniques in the prior art for preventing such deposits and consequent nozzle plugging from occurring.

One approach to the nozzle plugging problem has been the provision of devices for applying anti-wetting solvents to the print head between print runs to prevent ink from accumulating around the nozzle openings. For example, U.K. patent application GB2203994 to Takahashi et al. discloses an applicator for applying anti-wetting compositions to the nozzles on the face of a print head of an ink drop printer. The print head, which is reciprocably movable across the face of a platen, is periodically moved to one end of the platen where the applicator is placed. The applicator includes an extendable pad which then wipes the face of the print head. Similarly, European patent application 0621136 to Claslin et al. discloses a wet wipe maintenance device for a full width ink jet printer. A shuttle is mounted on a track to move along a fixed path parallel to an array of nozzle openings present in the surface of a print head. Mounted on the shuttle are an applicator for applying a liquid to the nozzle openings and a vacuum device for applying suction to the openings. The applicator is a wick of urethane felt through which water is supplied. U.S. Pat. No. 4,306,245 to Kasugayama et al. also discloses a device for cleaning discharge nozzles of an ink jet print head. When the print head moves to a print scanning region, ink in the nozzles is discharged into an opening leading to an ink recovery tank to clear them. Ink adhering around the discharge nozzles is then rubbed off by a liquid absorber fitted into the device.

Another approach to eliminating or at least ameliorating the nozzle plugging problem has been the development of new ink compositions which are less apt to build up deposits around the nozzles in the print head. For example, Carlson et al. U.S. Pat. No. 5,725,647 discloses a pigmented ink formed from an aqueous medium having dispersants for reducing the agglomeration of pigment particles in order to reduce or eliminate the deposition of foreign substances on heater elements during the jetting process. Similarly, Yamashita et al. U.S. Pat. No. 5,431,722 discloses an ink for ink jet printing comprising water, a colorant and a water soluble organic solvent and an amine for reducing clogging and unevenness of jetting.

Finally, U.S. Pat. No. 5,350,616 to Pan et al. discloses a composite orifice plate for an ink jet printer having a non-wettable layer of polymer material over the outside surface of the print heat for eliminating "ink puddling" which can occur on the plate and create a misdirection of spraying ink droplets during ejection.

Unfortunately, all of the aforementioned solutions to nozzle clogging have their shortcomings. For example, mechanical wiping devices add to the complexity and the expense of manufacturing the nozzle jet printer, and are not completely reliable in eliminating the ink deposits which cause clogging. Similarly, while some of the clogging problems may be ameliorated by the use of anti-clogging ink compositions, such inks have failed to eliminate the problem entirely. While the use of non-wettable polymeric materials offers some relief from the clogging problem, it has created other problems. For example, when the entire nozzle plate is formed from such a polymer, the interior of the surface of the resulting nozzles is not adequately wettable, which makes it difficult to modulate ink droplets of uniform size therethrough. The durability of the resulting nozzle plate is also reduced since such polymeric materials are softer and less wear resistant than metallic materials. Finally, few polymers will withstand the high temperatures needed for the fabrication of piezo actuators.

Clearly, what is needed is an improved nozzle plate which is not dependent upon the use of a mechanical wiping device to prevent potentially clogging deposits of dried ink from forming in the vicinity of the ink jet nozzles. Ideally, the outer and inner surface of such a nozzle plate could be formed from a metal or metal alloy to maintain the durability of the print head, and wettability of the nozzle interiors. It would further be desirable if the print head could be easily manufactured using readily accessible and inexpensive materials.

SUMMARY OF THE INVENTION

Generally speaking, the invention is an ink jet print head that eliminates or at least ameliorates all of the aforementioned clogging problems associated with prior art print head plates. Structurally, the invention is an ink jet print head that comprises a nozzle plate having an outer metal layer that includes nozzles for ejecting ink drops and a coating of a non-wetting polymer that is chemically bound to the outer surface of the metal layer of the plate. The non-wetting polymer includes at least one type of chemical group that ionically or datively bonds with the metal forming the nozzle plate. In the preferred embodiment, the non-wetting polymer is a block polymer having a head that includes the aforementioned chemically bonding chemical group, and a tail that is hydrophobic. The polymers forming the coating inherently arrange themselves into a dense array throughout the entire outside surface of the metal layer of the print head so as to provide a strongly bonded, non-wetting layer around the vicinity of the plate nozzles that resist the accumulation and drying of ink in these areas.

The metal forming the nozzle plate may be an alloy of gold, silver, or cadmium, and the coating polymer may include a chemical group that contains sulfer, selenium, or tellurium. The metal forming the nozzle plate may also be an alloy of one of the group consisting of aluminum, silicon, indium, scandium, hafnium, titanium, and zirconium, and the coating polymer may include siloxane groups. The metal layer may also be formed from an alloy including platinum, palladium, nickel, cobalt, or iridium, and the polymer may have pendant or chain carbon-carbon double bond for chemically bonding to the surface of the nozzle plate.

While the invention is described with reference to a piezoelectric ink jet print head, it is compatible with thermal or any other types of ink jet print heads, including but not limited to drop-on-demand ink jet printers.

The non-wettability of the exterior polymeric coating virtually eliminates the opportunity for liquid ink to cling to the nozzle plate, dry, and form ink jet clogging deposits. While it would be, of course, possible to fabricate the entire nozzle plate from a non-wettable polymer, such plates do not inherently provide a wettable inner surface for the ink ejecting nozzles, which in turn interferes with the reliability and control of the printing operation. The invention, by maintaining the use of a layer of metal in the nozzle plate, inherently provides for a wettable surface for the inner surfaces of the nozzle. The use of a metal layer in lieu of a polymer layer provides for a harder and more durable nozzle plate. Finally, the chemical bonding between the polymeric coating and the outer surface of the metallic nozzle plate makes it difficult to abrade the coating away from the surface of the metal in the event that auxiliary wiping devices are used in conjunction with the print head.

DETAILED DESCRIPTION OF THE INVENTION

Figure 1:
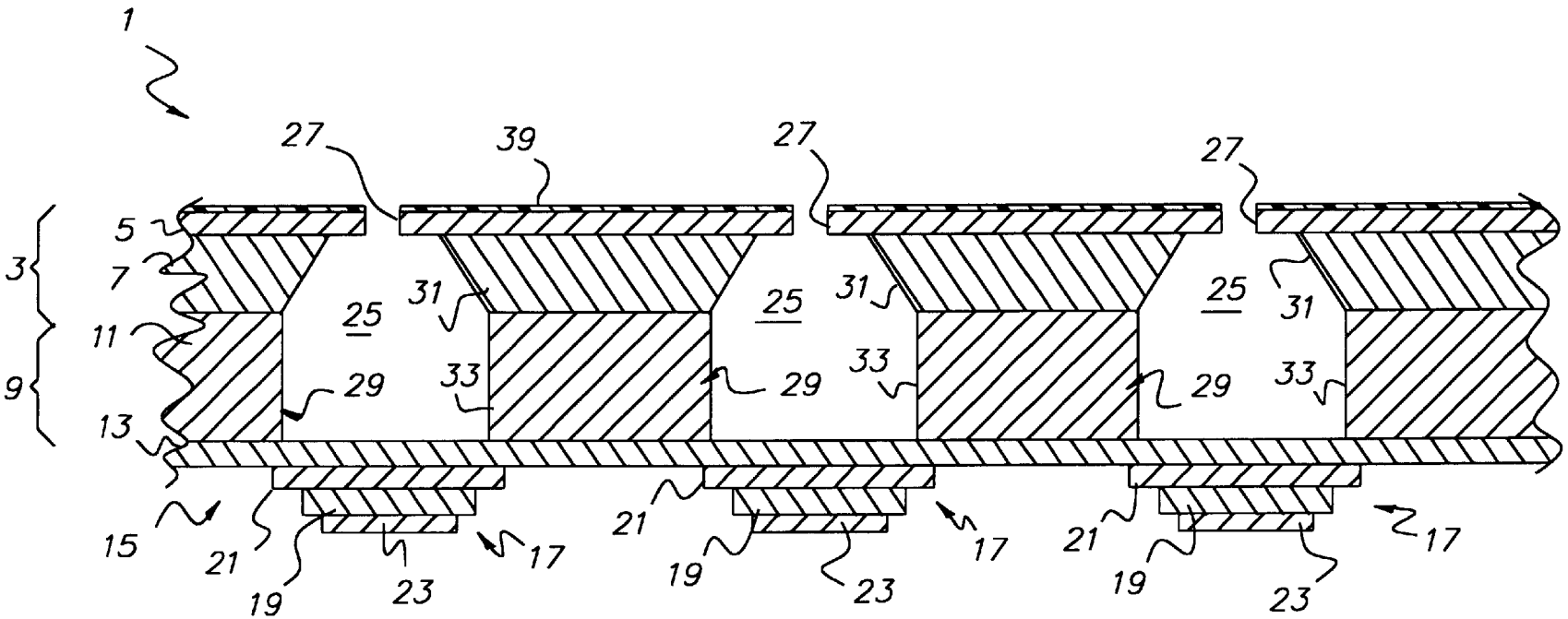
FIG. 1 is a schematic representation of a partial cross-sectional side view of a piezoelectric print head employing the invention.
Figure 2:
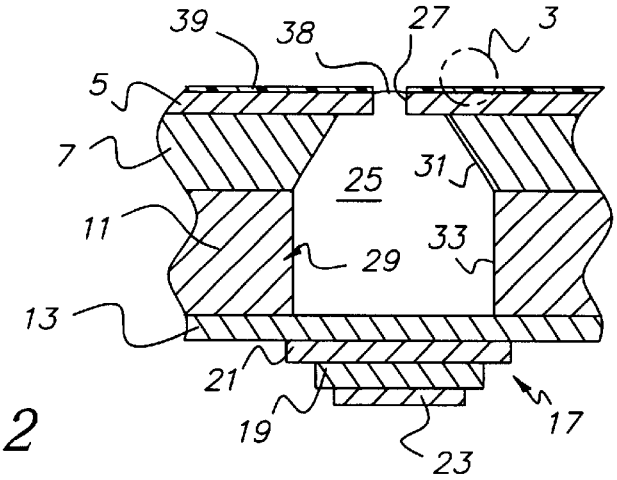
FIG. 2 is an enlargement of one of the nozzles of the print head of FIG. 1 shown filled with ink.

With reference now to FIGS. 1 and 2, wherein like Figures designate like components throughout all of the several Figures, the ink jet print head 1 of the invention comprises an ink jet nozzle plate 3 overlying a base 9.

The ink jet nozzle plate 3 is formed from an outer layer of metal 5 that overlies an outer substrate 7. The outer layer of metal 5 is preferably formed from a non-corrosive metal or metal alloy such as (but not limited to) gold, silver, nickel, cadmium, platinum, palladium, cobalt, iridium, aluminum, silicon, indium, tin, scandium, hafnium, zirconium, or titanium. In the preferred embodiment, the outer layer of metal 5 is formed completely from one of the aforementioned metals or an alloy; however, outer layer 5 may be formed from a laminate consisting of an outer layer of one or more of the aforementioned metals overlying a base layer (not shown) of another possibly less expensive metal. The important aspect here, is that at least the outer surface 40 of the outer layer of metal 5 be formed from one of the aforementioned metals or an alloy thereof, and preferably from gold or silver.

Layer 5 overlies an outer substrate 7 as shown. Outer substrate 7 overlies and is connected to inner substrate 11 of the base 9. Inner substrate 11 may likewise be formed from a non-corrosive metal, such as stainless steel. Inner substrate 11 in turn overlies a diaphragm plate 13 under which a piezoelectric transducer assembly 15 is mounted. Diaphragm plate 13 may be formed from a non-corrosive, flexible metal such as stainless steel or nickel, or a flexible non-metallic material such as silicon nitride.

With particular reference to FIG. 2, the piezoelectric transducer assembly 15 is formed from a plurality of transducers 17. Each transducer 17 includes an actuator element 19 sandwiched between two electrodes 21,23. Each of the transducers 17 is mounted beneath one of the nozzles 25 of the ink jet print head 1. Each nozzle 25 includes an outlet bore 27 formed by drilling or punching a circular hole in the outer layer of metal 5 in the ink jet nozzle plate 3. Each of the nozzles 25 further have inner walls 29 including a tapered section 31, and a reservoir section 33. Because each of the components 5,7,11, and 13 of the ink jet print head 1 are formed from metals, the inner walls 29 of each of the nozzles 25 have metal surfaces which inherently causes them to be advantageously wettable with respect to water-based inks. Such wettability is needed to displace and remove air bubbles which, if allowed to remain within the nozzles, would compress in response to the pressure generated by the piezoelectric transducer assembly, thus interfering with the proper ejection of ink droplets.

The reservoir section 33 of each of the nozzles 25 serves to store a small volume of ink 37 which is constantly supplied to the nozzles 25 via a small bore (not shown). The tapered section 31 directs the ink toward the outlet bore 27 whenever an electric potential applied across the electrodes 21,23 causes the actuator element 19 to flex. The Flexible nature of the diaphragm plate 13 efficiently transfers mechanical energy generated by such element flexing by allowing the diaphragm plate 13 to buckle inwardly, thereby creating a hydraulic pressure which forces ink 37 through the outlet bore 27. Due to the surface tension inherent in water-based inks, ink 37 disposed in the interior of the nozzles 25 forms a convex meniscus 38 around the outlet bore 27 of each nozzle 25. It is this surface tension that causes the ink to eject out of the bore 27 in the form of spherical droplets whenever the piezoelectric transducer assembly 15 generates pressure in the ink 37 disposed in the interior of the nozzles 25.

Figure 3:
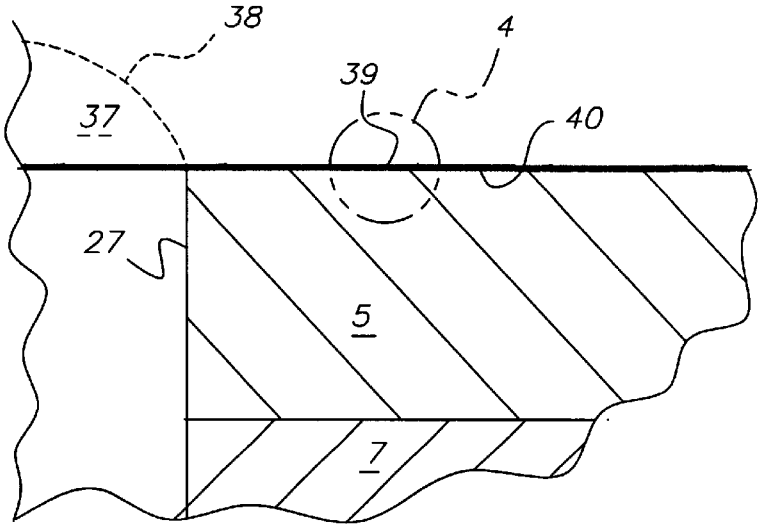
FIG. 3 is an enlargement of the circled area of the ink jet nozzle plate shown in FIG. 2, in the vicinity of the nozzle bore illustrating, on a greatly enlarged scale, the block polymer that constitutes the non-wettable layer of the invention.
Figure 4:
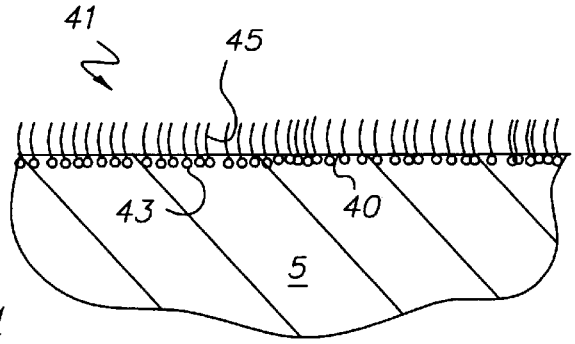
FIG. 4 is an enlargement of the circled area of FIG. 3 illustrating the head and tail structure of the block polymers used to form the coating of the invention.

With reference now to FIGS. 3 and 4, a non-wettable polymeric coating 39 is chemically bound over the outer surface 40 of the outer layer of metal 5. Polymeric coating 39 is formed from a polymer which can form a chemical bond with the metal forming the outer surface 40 of the metal layer 5, but which is also non-wettable. In the preferred embodiment, coating 39 is formed from a block polymer 41 having a head 43 which is chemically reactive with the metal forming the outer surface 40, but has a tail 45 which is hydrophobic.

It will be understood by those skilled in the art that the scale of the block polymers 41 illustrated in FIGS. 3 and 4 is not accurate, and that the molecules are much enlarged from their true size for illustrative purposes.

The specific composition of the block polymer 41 will, of course, vary with the metal or metals forming the outer surface 40 of outer layer 5. For example, if the outer surface 40 of outer layer 5 is gold or silver, the block polymer 41 may be a thiol or sulfide-containing polymer, such as an alkane sulfide, or polystyrenethiol, both of which have a high affinity to silver or gold, and readily form a close-packed array on the surface 40, with the sulfide groups forming the head 43 chemically bonding to the gold or silver surface and the hydrocarbon groups forming the tail 45 extending away from the silver surface in appearance much like a dense forest of hydrocarbon foliage on a gold or silver field. The resulting hydrocarbon surface has a lower surface energy, and is not wetted by the ink that periodically passes out through the nozzle bore 27, thus insuring that injected ink droplets "see" a clean surface during the printing operation and do not pass through a layer of ink or ink deposits as they are ejected. The polymers may have either pendant or chain sulfer groups, and may alternatively have selenium or tellurium groups for forming the head 43 of the block polymer 41. With such polymers, cadmium may be used as well as gold or silver to form the outer surface 40 of the outer metal layer 5.

The gold, silver, or cadmium surface 40 may be created by forming the entire outer layer 5 from the metal, or by (as indicated earlier) plating a layer of the metal over a cheaper non-corrosive metal by chemical plating or by vacuum evaporation. The polymeric coating 39 may be formed by many conventional methods. Wetting the surface with a solution of the polymer and allowing the bonds to form before rinsing off the excess will suffice for many strongly bonded polymers. Vacuum evaporation or sputtering can be used for low molecular weight polymers. Lamination of the polymer over the outer surface 40 via a carrier substrate, constitutes still another method for forming the coating 39.

Many other kinds of metals may be used for the outer surface 40 of the ink jet nozzle plate 3. For example, aluminum, silicon, indium, tin, scandium, hafnium, and zirconium may be used. When such metals are used, the polymer forming the coating 39 may be chosen from the family of polymers having pendant siloxane groups in either the head or the backbone of the block polymer 41. The bonding between the metal surface 40 and the block polymer 41 in such a case is through a silicon-oxygen-metal bond.

In still another embodiment of the invention, the outer surface 40 of the metal layer 5 may be formed from platinum, palladium, nickel, cobalt, or iridium. In such a case, the polymer is chosen from the group of polymers that have pendant or chain carbon-carbon double bonds.

In all instances, because of the chemical bonding between the polymeric coating 39 and the outer surface 40 of the metal layer 5, the coating 39 is securely bound over the outer surface 40. In contrast to adhesive bonds, which are formed by Vander Waals forces (i.e., dipole to dipole electrostatic interactions), the bonding between the coating 39 and outer surface 40 is formed by simple covalent bonds, or dative bonds, either of which is much stronger than Vander Waal forces. Consequently, the coating 39 advantageously protects the metallic surface of the ink jet nozzle plate 3 from physical abrasion, as it is not easily rubbed off. It is well known in the art that abrasion of the outer surface 40 of such ink jet nozzle plates 3 may be caused by the pigmented particles in the inks as they are forcefully ejected through the outlet bores 27 in the metal layer 5. Such abrasion can be caused by air borne dust, or by the wiping operation that occurs during routine print head cleaning. The tail 45 of the block polymers 41 constituting the polymeric coating 39 acts as a shield in protecting the metallic outer surface 40 from such abrasions. In order to enhance the abrasion resistance of the block polymer, each of the aforementioned polymer chains may be advantageously fluorinated such that a "Teflon" -like counterpart of the polymer is created.

The following examples will illustrate the practice of the invention:

EXAMPLE 1

A silver surface was prepared by sputtering a layer of silver onto a glass microscope slide. The silver surface was spin coated with a 5% solution of the reaction product of pentaerythritol triacrylate and ethyl mercaptan (1:1 molar equivalents) in methyl isobutyl ketone containing 0.5% Michler's Ketone as a photosensitizer. When dry, the coated slide was exposed to 120 units of radiation from a Nu-Arc high pressure quartz halogen lamp to effectively polymerize the acrylate groups. When cured, a drop of water was placed on the surface which showed a very high contact angle. When the microscope slide with the drop of water was tipped on its side the water drop ran off cleanly, without wetting the surface.

EXAMPLE 2

Example 1 was repeated, but the metal used was a mixture of palladium and platinum. The polymer used was vinyl terminated polydimethysiloxane obtained from the Aldrich Chemical Company. No radiation cure was needed. When the spin coating solvent had dried, the polymer was bound to the metal by the vinyl groups. Again, water would not wet the surface.

While the invention has been described in detail with particular reference to a piezoelectric-type ink jet print head, the invention is compatible with virtually any type of ink jet print head, such as thermal-type heads.

EXAMPLE 3

A gold surface was prepared by sputtering a layer of gold onto a glass microscope slide. The gold surface was spin coated with a 1% solution of (mercaptopropyl) methyldimetbylsiloxane copolymer (Petrarch Systems, Bartram Road, Bristol, Pennsylvania) in toluene. When dry, water would not wet the surface.

EXAMPLE 4

Example 3 was repeated, but the polymer used was a polydimehylsiloxane mercaptopropyl T-structure branch copolymer, also from Petrarch Systems, Bartram Road, Bristol, Pennsylvania at a 1% concentration in toluene.

The invention has been described in detail with particular reference to certain preferred embodiments thereof, but it will be understood that variations and modifications can be effected within the spirit and scope of the invention.

PARTS LIST

1. Ink jet print head
3. Ink jet nozzle plate
5. Outer layer of metal
7. Outer substrate
9. Base
11. Inner substrate
13. Diaphragm plate
15. Piezoelectric transducer assembly
17. Transducers
19. Actuator element
21. Electrode
23. Electrode
25. Nozzles
27. Outlet bore
29. Inner walls
31. Tapered section
33. Reservoir section
37. Ink
38. Meniscus
39. Polymeric coating
40. Outer surface
41. Polymer (block)
43. Head
45. Tail

What is claimed is:

1. An ink jet print head comprising:

a nozzle plate having an outer metal layer and including nozzle openings for ejecting ink drops, said outer metal layer being selected from the group consisting of gold, silver, cadmium and alloys thereof; and a coating of a non-wetting polymer having a bonding chemical group chemically bound to the outer metal layer, said bonding chemical group comprising a sulfur compound that is a block copolymer of a polystyrenethiol.

2. The ink jet print head of claim 1 wherein the sulfur compound is either in pendant or chain form.

3. The ink jet print head of claim 1 wherein an inside surface of a nozzle leading to a nozzle opening is a metal that is wettable to the ink to reduce accumulation of bubbles in the nozzle.

4. An ink jet print head comprising:

a nozzle plate having an outer metal layer and including nozzle openings for ejecting ink drops, said outer metal layer being selected from the group consisting of platinum, palladium, nickel, cobalt and iridium and alloys thereof; and a coating of a non-wetting polymer having a bonding chemical group chemically bound to the outer metal layer, said bonding chemical group comprising a pendant or chain carbon-carbon double bond.

5. The ink jet print head of claim 4 wherein an inside surface of a nozzle leading to the nozzle openings is a metal that is wettable to the ink to reduce accumulation of bubbles in the nozzle.

6. The ink jet print head of claim 4 and including a piezoelectric transducer for driving ink through a nozzle opening.

7. The ink jet print head of claim 1 and including a piezoelectric transducer for driving ink through a nozzle opening.

8. The ink jet print head of claim 2 wherein an inside surface of a nozzle leading to a nozzle opening is a metal that is wettable to the ink to reduce accumulation of bubbles in the nozzle.

9. The ink jet printhead of claim 8 and including a piezoelectric transducer for driving ink through a nozzle opening.

* * * * *